US006935291B2

(12) United States Patent
Kusano et al.

(10) Patent No.: US 6,935,291 B2
(45) Date of Patent: Aug. 30, 2005

(54) VARIABLE VALVE TIMING CONTROLLER

(75) Inventors: Shigeyuki Kusano, Okazaki (JP); Yasushi Morii, Nagoya (JP); Tadao Ikihara, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/007,348

(22) Filed: Dec. 9, 2004

(65) Prior Publication Data

US 2005/0126527 A1 Jun. 16, 2005

(30) Foreign Application Priority Data

Dec. 15, 2003 (JP) ..... 2003-416248

(51) Int. Cl.[7] ..... F01L 1/34

(52) U.S. Cl. ..... 123/90.17; 123/90.15; 123/90.31

(58) Field of Search ..... 123/90.17, 90.15, 123/90.31

(56) References Cited

U.S. PATENT DOCUMENTS 5,947,067 A 9/1999 Kawaharaguchi et al. ..... 123/90.17
6,460,496 B2 * 10/2002 Fukuhara et al. ..... 123/90.17

* cited by examiner

*Primary Examiner*—Thomas Denion
*Assistant Examiner*—Zelalem Eshete
(74) *Attorney, Agent, or Firm*—Nixon & Vanderhye P.C.

(57) ABSTRACT

A projected portion is provided on an outer wall surface of the vane. The projected portion projects toward the inner wall surface of the circumferential wall in a rotational direction. When the inner wall surface and the outer wall surface are contact with each other at the projected portion, a center point of a force applied to the projected portion is located outside of an contacting area where the bolt is threaded into the circumferential wall in order that the circumferential wall is connected with the side wall by the bolt. The circumferential wall can be bent in the rotational direction by the force. Thereby, even if the vane beats the inner wall surface, the shoe-housing hardly deviates in the rotational direction to restrict the bolt from loosing.

8 Claims, 4 Drawing Sheets

VARIABLE VALVE TIMING CONTROLLER

CROSS REFERENCE TO RELATED APPLICATION

This application is based on Japanese Patent Application No. 2003-416248 filed on Dec. 15, 2003, the disclosure of which is incorporated herein by reference.

FIELD OF THE INVENTION

The present invention relates to a variable valve timing controller that changes opening and closing timing of intake valves and/or exhaust valves of an internal combustion engine according to operating condition of the engine. The opening and closing timing is referred to as valve timing, the variable valve-timing controller is referred to as the VVT controller, and the internal combustion engine is referred to as an engine hereinafter.

BACKGROUND OF THE INVENTION

A VVT controller drives a camshaft through a timing pulley and a chain sprocket, which rotates in synchronization with a crankshaft of the engine, in order to change the valve timing of at least the intake valve and the exhaust valve. The valve timing is adjusted by changing a rotational phase of the camshaft relative to the timing pulley and the chain sprocket. Conventional VVT controller has vanes to drive the camshaft by means of an oil pressure. Such a conventional VVT controller having vanes is shown in Japanese Patent No.3196696 which is a counterpart of USP-5947067. The VVT controller has a housing which comprises an annul circumferential wall and side walls covering an opening ends of the annular circumferential wall. The housing accommodates a vane rotor having the vanes. The vanes define an advanced chamber and a retard chamber in to which an oil pressure is introduced in order to rotate the vane rotor.

As shown in FIG. 7, the housing 300 comprises a circumferential wall 304 and side walls 302, 306. The side wall 302 is formed integrally with the circumferential wall 304, and the side wall 306 is individually formed. A connecting portion 305 of the circumferential wall 302 is fixed on the side wall 306 by a bolt 310. The vane 308 is rotatably accommodated in the housing 300. An outer wall surface 308*a* of the vane 308 can be in contact with an inner wall surface 304*a* of the circumferential wall 304 in a rotational direction.

When the vehicle is in a hard cornering or when the engine is re-started right after an engine stall, the advance chamber or retard chamber is not filled with an oil. In such a situation, when the vane rotor receives a load torque, the outer wall surface 308*a* of the vane 308 sometimes beats the inner wall surface 304*a* of the circumferential wall 304. The load torque is a variation torque which fluctuates between an advanced direction or a retarded direction, and which the camshaft receives in a time of opening and closing the intake valve or exhaust valve.

The contacting area "d" where the bolt 310 is threaded into the connecting portion 305 receives a beating force of the vane 308 so that the circumferential wall 304 may be displaced relative to the side wall 306 to loose the bolt 310, and the oil may flows out through a clearance gap between the circumferential wall 304 and the side wall 306.

SUMMARY OF THE INVENTION

The present invention is made in view of the foregoing matter and it is an object of the present invention to provide the VVT controller in which the bolt connecting the housing parts is restrained from loosing.

According to a VVT controller of the present invention, a projected portion is provided on one of an inner wall surface of the circumferential wall and an outer wall surface of the vane. The projected portion projects toward the outer wall surface of the vane or the inner wall surface of the circumferential wall in a rotational direction. When the inner wall surface and the outer wall surface are contact with each other at the projected portion, a center point of a force applied to the projected portion is located outside of an contacting area where the bolt is threaded into the circumferential wall in order that the circumferential wall is connected with the side wall by the bolt.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENT

An embodiment of the present invention will be described hereinafter with reference to the drawings.

First Embodiment

Figure 3:
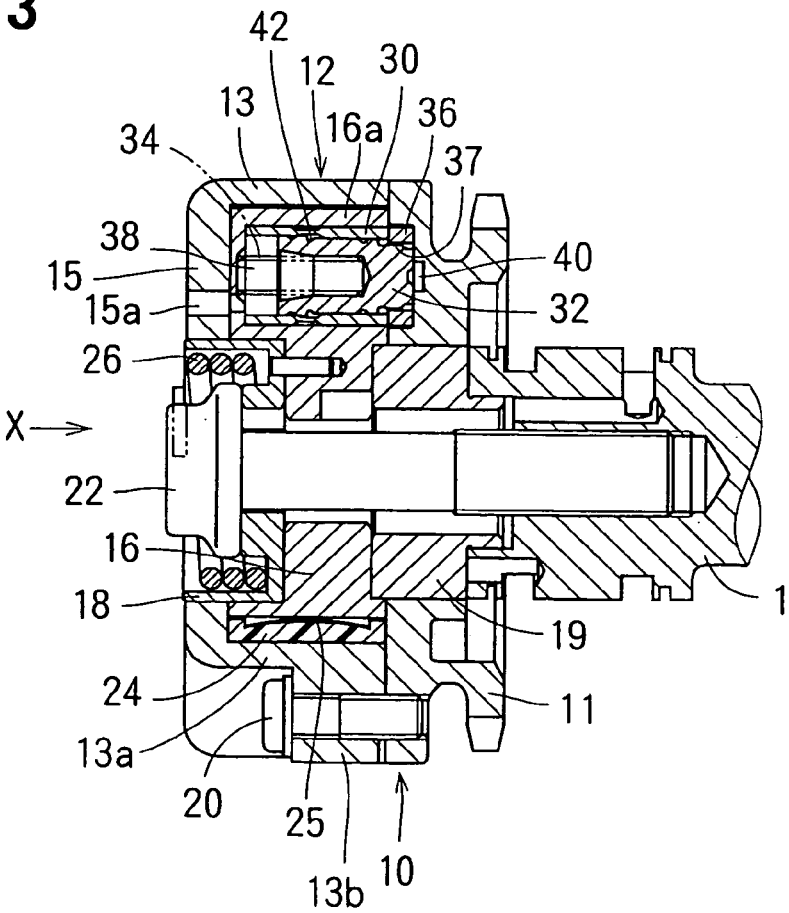
FIG. 3 is a cross sectional view along a line III—III in FIG. 2.

FIG. 3 shows a VVT controller according to a first embodiment. The VVT controller 10 is activated by an oil pressure and controls the valve timing of the exhaust valve.

A chain sprocket 11, which corresponds to a side wall of a driving rotation member, receives a driving force from a crankshaft (not shown) through a chain to rotate in synchronization with the crankshaft. A camshaft 1 receives the driving force from the chain sprocket 11 to drive the exhaust valve (not shown). The camshaft 1 can rotate relative to the chain sprocket 11 within a predetermined rotational phase deference. The chain sprocket 11 and the camshaft 1 rotate clockwise direction viewed along an arrow X in FIG. 3. This clockwise direction is defined as an advance direction.

The chain sprocket 11 and a shoe-housing 12 configure a housing as a driving rotation member. The shoe-housing 12 comprises a circumferential wall 13 and a front plate 15 which are integrally made of aluminum alloy. The front plate 15 corresponds to the other side wall. The circumferential wall 13 includes an annular portion 13*a* and a connecting portion 13*b* which extends radially outwardly. The connecting portion 13*b* is connected with the chain sprocket 11 by a bolt 20.

Figure 2:
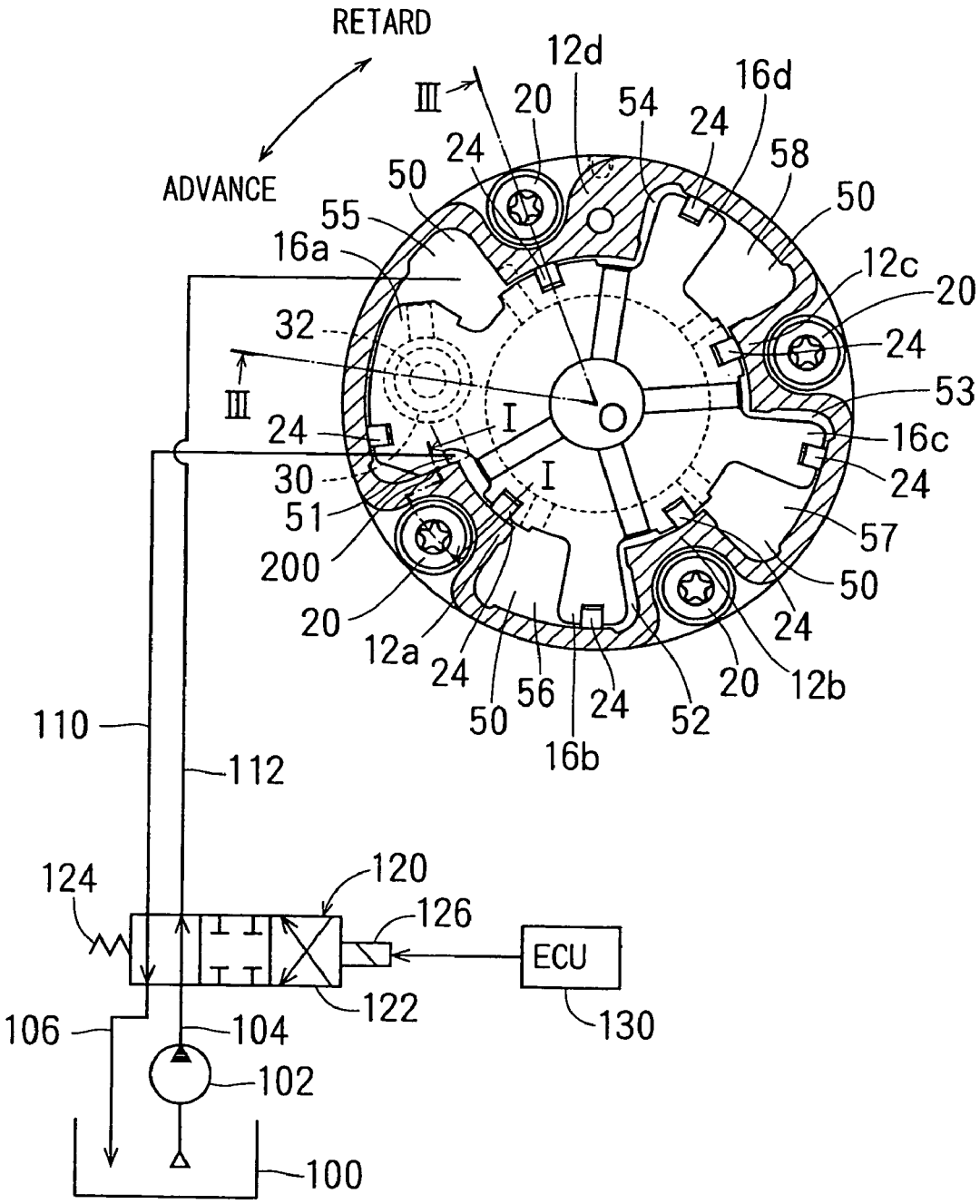
FIG. 2 is a cross sectional view of the VVT controller along the edge line of the front plate.

As shown in FIG. 2, the shoe-housing 12 includes shoes 12*a*, 12*b*, 12*c*, 12*d* which are projected inward from the annular portion 13*a*, and which are disposed in the circumferential direction at regular intervals. FIG. 2 is a cross sectional view along an inner end surface of the front plate 15 of FIG. 3. Between adjacent shoes, there is provided four chambers 50 each of which respectively accommodates each vane 16*a*, 16*b*, 16*c*, 16*d*. The chambers 50 are sector-shaped to receive vanes 16*a*, 16*b*, 16*c*, 16*d*. Inner surfaces of the shoes 12*a*, 12*b*, 12*c*, 12*d* are arc-shaped.

The vane rotor 16 as a driven rotation member is provided with the vanes 16*a*, 16*b*, 16*c*, 16*d* each of which is accommodated in the chamber 50. Each of vanes 16*a*, 16*b*, 16*c*, 16*d* divides respective chamber 50 into a retard chamber and an advance chamber into which an oil is introduced to rotate the vane rotor 16. An arrow in FIG. 2 indicates a retard direction and an advance direction of vane rotor 16 relative to the shoe-housing 12. The vane rotor 16 can rotate to a position where the outer wall surface 17 of the vane 16*a* confronts to the inner wall surface 14 of the circumferential wall 13 as shown in FIG. 1. FIG. 1 shows a situation in which the outer wall surface 17 confronts to the inner wall surface 14 in a most retarded angle. In a most advanced angle, the other outer wall surface 17 of the vane 16*a* confronts to the inner wall surface 14. The vane 16*a* is provided with a projected portion 17*a* which can be contact with the inner wall surface 14 at the area which is oust side of an contacting area "d" where the bolt 20 is threaded into the connecting portion 13*b*. The projected portion 17*a* projects in the rotational direction of the vane rotor 16.

As shown in FIG. 3, the vane rotor 16, a front bush 18 and rear bush 19 configure the driven rotation member, which are integrally connected with the camshaft 1 by a bolt 22. The camshaft 1, vane rotor 16, the front bush and the rear bush 19 can coaxially rotate relative to the chain sprocket 11 and the shoe-housing 12.

A seal member 24 is engaged with the outer wall surface of the vane rotor 16 as shown in FIG. 2. A gap clearance is formed between the outer circumferential surface of the vane rotor 16 and the inner surface of the circumferential surface 13. The seal member 24 restricts an oil leakage through the gap clearance. As shown in FIG. 3, the seal member is urged into the circumferential wall 13 by mean of a plate spring 25.

One end of a spring 26 is engaged with a shoe-housing 12, and the other end of the spring 26 is engaged with the vane rotor 16. The spring 26 biases the vane rotor 17 in the advance direction relative to the shoe-housing 12.

The load torque which the camshaft 1 receives in actuating the exhaust valve fluctuates between a plus side and a minus side. The plus direction of load torque represents the retard direction and the minus direction of load torque represents the advance direction of the vane rotor 16 relative to the shoe-housing 12. The average torque is in the plus side, which is in retard direction. The spring 26 supplies an advance direction torque to the vane rotor 16, which is substantially equal to the average load torque that the camshaft receives.

A guide ring 30 is press-inserted into a hole 38 formed in the vane 16*a*. A cylindrical stopper pin 32 is slidablly inserted in the guide ring 30. A spring 34 urges the stopper pin 32 toward an engaging ring 36 which is press-inserted into the chain sprocket 11. The engaging ring 36 is provided with an engaging hole 37 into which the stopper pin 32 is inserted.

A tip end portion of the stopper pin 32 is tapered to be inserted into the engaging ring 36. The inner diameter of the engaging hole 37 is also tapered so that the stopper pin 32 is smoothly inserted into the engaging ring 36.

When the stopper pin 32 is engaged with the engaging ring 36, a rotational movement of the vane rotor 16 relative to the shoe-housing 12 is restricted. When the stopper piston 32 is engaged with the engaging ring 36 in a predetermined angle, the rotational phase of the camshaft 1 relative to the crankshaft is the best phase for starting the engine. In the present embodiment, this rotational phase is a most advanced angle. The hole 38 communicates to the atmosphere through a communicating hole 15*a* at the most advanced angle. The reciprocating movement of the stopper pin 32 at the most advanced angle is not disturbed.

A first pressure chamber 40 communicates with a retard angle oil chamber 51, and a second pressure chamber 42 around the stopper pin 32 communicates with an advance angle oil chamber 42. The oil pressure in the first pressure chamber 40 and the second pressure chamber 42 act on the stopper pin 32 in a direction that the stopper pin 32 is withdrawn from the engaging ring 36.

As shown in FIG. 2, the retard angle oil chambers 51, 52, 53, 54 are respectively formed between the shoe 12*a*, 12*b*, 12*c*, 12*d* and the corresponding vane 16*a*, 16*b*, 16*c*, 16*d*. The advance angle oil chamber 55, 56, 57, 58 are respectively formed between the shoes 12*d*, 12*a*, 12*b*, 12*c* and the corresponding vane 16*a*, 16*b*, 16*c*, 16*d*.

An oil supply passage 104 is connected with an oil pump 102, and an oil drain passage 106 is opened in a drain pan 100. The oil pump 102 pumps up the oil from the oil pan 100 to supply the oil to the chambers through a switching valve 120 and oil passages 110, 112. FIG. 2 shows that the oil passage 110 communicates with the retard angle oil chamber 51 and the oil passage 112 communicates with the advance angel oil chamber 55. Practically, the oil passage 110 communicates with the retard angle oil chambers 51, 52, 53, 54, the oil passage 112 communicates with the advance angle oil chambers 55, 56, 57, 58.

The switching valve 120 comprises a spool 122, a spring 124 and a solenoid 126. The solenoid 126 generates an electric magnetic force which displaces the spool 122 against a biasing force of the spring 124. An electric control unit (ECU) 30 controls a duty ratio of an electric current supplied to the solenoid 126 in order to control the position of the spool 122. When the solenoid is not energized, the spool 122 is urged by the spring 122 to be positioned as shown in FIG. 2.

The operation of the vane 16*a* is described hereinafter, in which the outer wall surface 17 of the vane 16*a* beats the inner wall surface 14 of the circumferential wall 13.

When each of the retard angle oil chamber and the advance angle oil chamber is filled with the oil, the rotational position of the vane rotor 16 hardly fluctuates even when the vane rotor 16 receives the load torque from the camshaft 1.

When the vehicle is in a hard cornering or when the engine is re-started right after an engine stall, the advance chamber or retard chamber is not filled with an oil. In such a situation, when the vane rotor 16 receives a load torque of the camshaft 1, the rotational position of the vane rotor 16 fluctuates, so that the outer wall surface 17 of the vane 16*a* may beats the inner wall surface 14 of the circumferential wall 13.

Figure 1A:
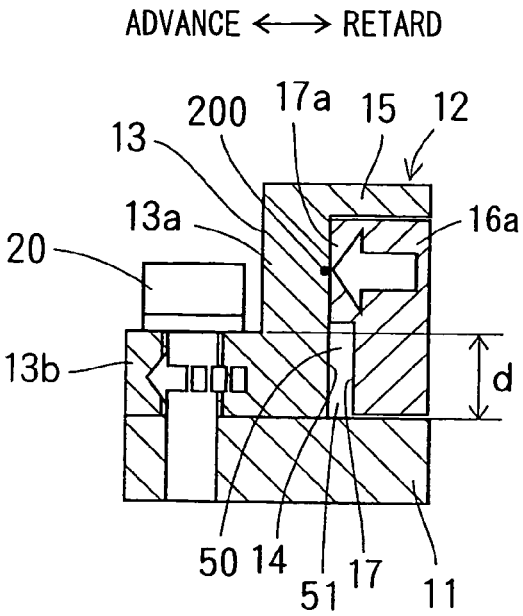
FIG. 1A and FIG. 1B are cross sectional views schematically showing a collision between a housing and a vane according to the first embodiment of the present invention, FIG. 1A showing an instant when the vane collides with the housing, and FIG. 1B showing a situation in which the housing is bent.
Figure 1B:
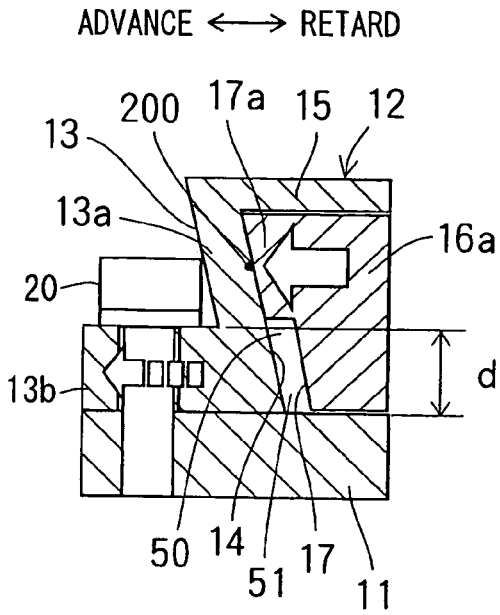

According to the first embodiment, the vane 16*a* is provided with a projected portion 17*a* which can be contact with the inner wall surface 14 at the area which is outside of an contacting area "d" where the bolt 20 is threaded into the connecting portion 13*b*. When the projected portion 17*a* beats the inner wall surface 14, the center point 200 of the beating force is located outside of the contacting area "d". Thereby, the beating force is hardly applied to the contacting area "1*d*". Furthermore, the thickness of the annular portion 13*a* with which the projected portion 17*a* is in contact is thinner than that of the connecting portion 13*b*. AS a result, when the projected portion 17*a* confronts the inner surface 14 as shown in FIG. 1A, the circumferential wall 13 can be bent in the rotational direction by the force illustrated by an arrow in FIG. 1B. FIG. 1B exaggeratedly shows such a situation in which the circumferential wall 13 is bent. Thereby, even if the vane 16*a* beats the inner wall surface 14, the shoe-housing 12 hardly deviates in the rotational direction to restrict the bolt 20 from loosing.

Modified Embodiment

Figure 4A:
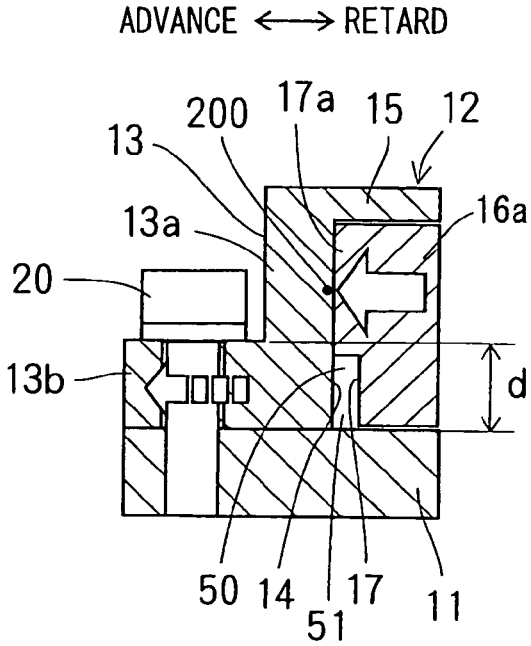
FIG. 4A and FIG. 4B are cross sectional views schematically showing a collision between a housing and a vane according to the modified embodiment of the first embodiment, FIG. 4A showing an instant when the vane collides with the housing, and FIG. 4B showing a situation in which the housing is bent.
Figure 4B:
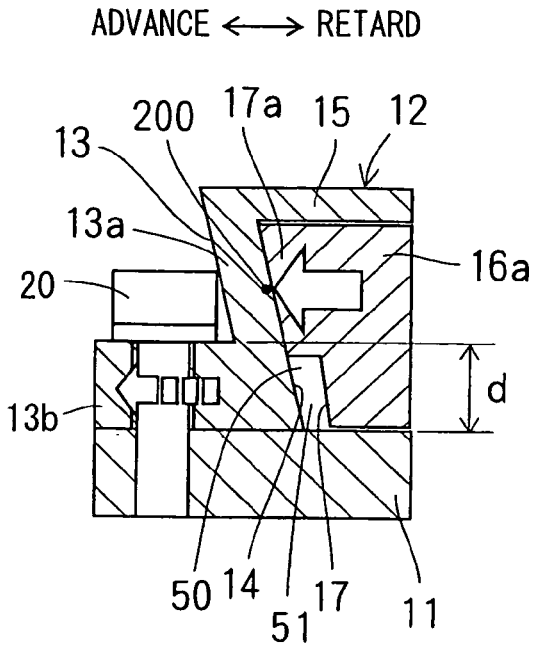

FIGS. 4A, 4B show a modified embodiment of the first embodiment. A part of the projected portion 17*a* overlaps the contacting area "d". The center point 200 of the beating force is located outside of the contacting area "d". AS a result, when the portion 17*a* confronts the inner surface 14 as shown in FIG. 4A, the annular portion 62*a* and the bolt 20 can be bent in the rotational direction by the force illustrated by an arrow in FIG. 1B. Thereby, even if the vane 16*a* beats the inner wall surface 14, the shoe-housing 12 hardly deviates in the rotational direction to restrict the bolt 20 from loosing.

Second Embodiment

Figure 5A:
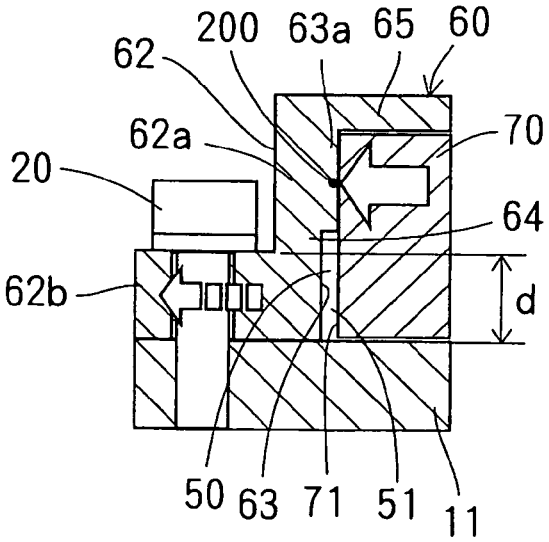
FIG. 5A and FIG. 5B are cross sectional views schematically showing a collision between a housing and a vane according to the second embodiment of the present invention, FIG. 5A showing an instant when the vane collides with the housing, and FIG. 5B showing a situation in which the housing is bent.
Figure 5B:
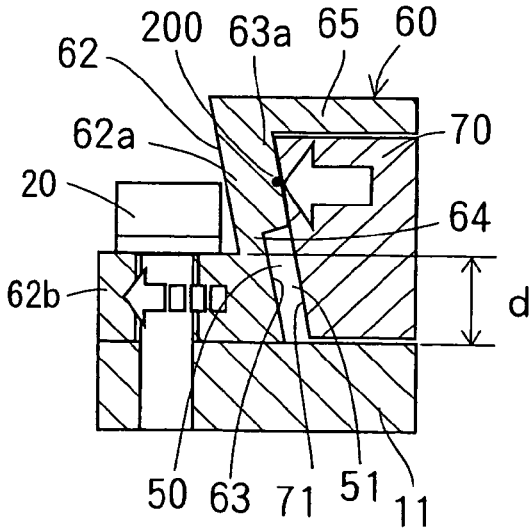

FIGS. 5A, 5B show a second embodiment, in which the same parts and components as those in the first embodiment are indicated with the same reference numerals and the same descriptions will not be reiterated.

A shoe-housing 60 includes a circumferential wall 62 and a front plate 65, which are integrally formed from an aluminum alloy. The circumferential wall 62 includes an annular portion 62*a* and a connecting portion 62*b* which radially outwardly extends. The connecting portion 62*b* is connected with the chain sprocket by the bolt 20.

The circumferential wall 62 includes a projected portion 63*a*. The projected portion 63*a* is located outside of the contacting area "d". The annular portion 62*a* includes a thin portion 64 of which thickness is thinner than that of the connecting portion 62*b*.

When the projected portion 63*a* beats the inner wall surface 63, the center point 200 of the beating force is located outside of the contacting area "d". Thereby, the beating force is hardly applied to the contacting area "d". AS a result, when the projected portion 63*a* confronts the inner surface 63 as shown in FIG. 1A, the circumferential wall 62 can be bent at the thin portion 64 in the rotational direction by the force illustrated by an arrow in FIG. 5B. FIG. 5B exaggeratedly shows such a situation in which the circumferential wall 13 is bent. Thereby, even if the vane 70 beats the projected portion 63*a*, the shoe-housing 60 hardly deviates in the rotational direction to restrict the bolt 20 from loosing.

Modified Embodiment of the Second Embodiment

Figure 6A:
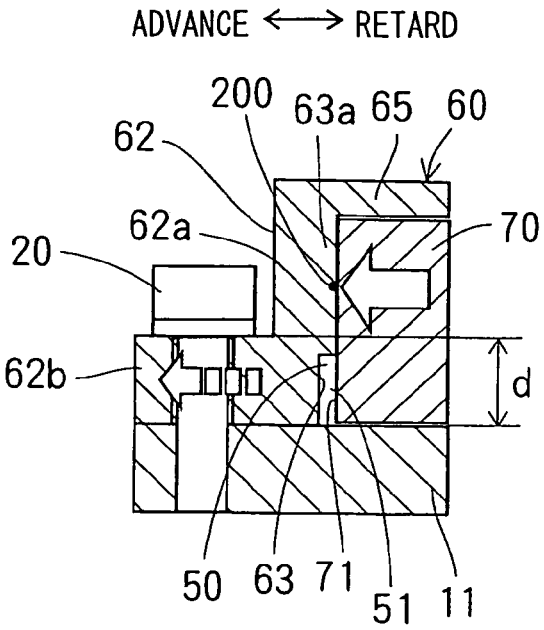
FIG. 6A and FIG. 6B are cross sectional views schematically showing a collision between a housing and a vane according to the modified embodiment of the second embodiment, FIG. 6A showing an instant when the vane collides with the housing, and FIG. 6B showing a situation in which the housing is bent.
Figure 6B:
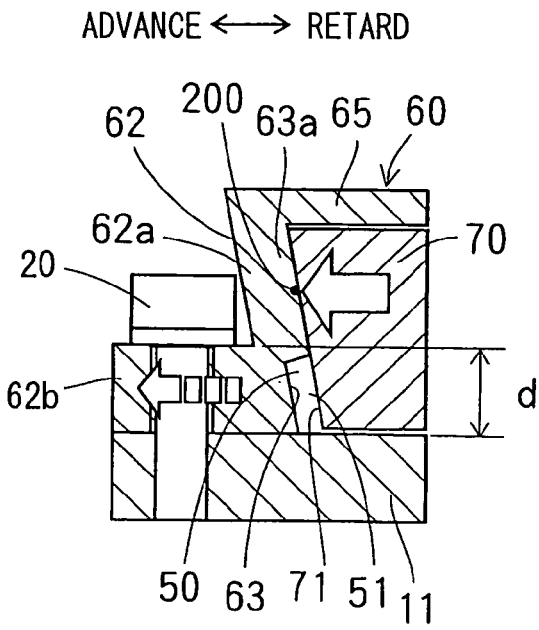
Figure 7:
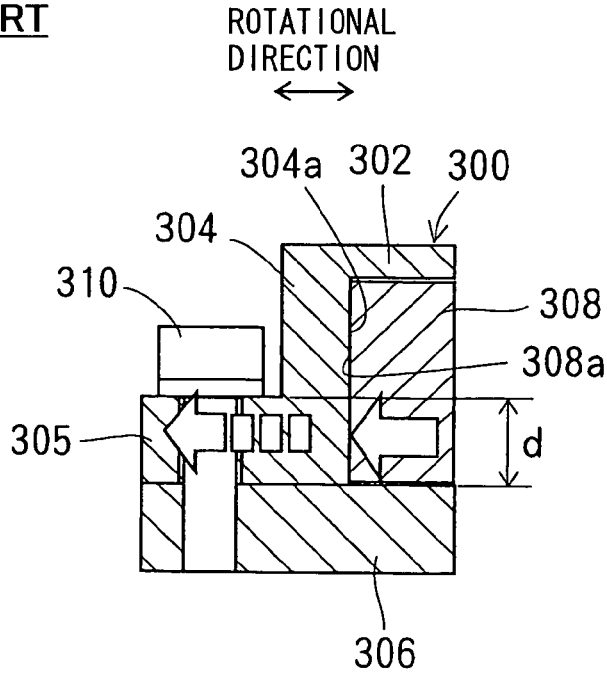
FIG. 7 PRIOR ART
FIG. 7 is a cross sectional view showing an instant when the vane collides with the housing in the conventional controller.

FIGS. 6A, 6B show a modified embodiment of the first embodiment. A part of the projected portion 63*a* overlaps the contacting area "d". The center point 200 of the beating force is located outside of the contacting area "d". When the projected portion 63*a* confronts the vane 70 as shown in FIG. 6A, the annular portion 62*a* and the bolt 20 can be bent in the rotational direction by the force illustrated by an arrow in FIG. 6B. Thereby, even if the vane 70 beats the inner wall surface 63, the shoe-housing 12 hardly deviates in the rotational direction to restrict the bolt 20 from loosing.

Another Embodiment

If the center point 200 of the force is located outside of the contacting area "d", the thickness of the annular portion 13*a* to which the projected portion 17*a* confronts can be equal to or thicker than that of the connecting portion 13*b*.

The shoe-housing can be made from other material rather than aluminum alloy. The circumferential wall and the front plate can be made as separate members. The bolt 20 can be threaded from the side of chain sprocket 11.

In the aforementioned embodiments, the vane or circumferential wall is provided with the projected portion on the both side of rotational direction. The projected portion can be provided only one side of rotational direction.

The VVT controller can be applied to not only the intake valve but also the exhaust valve. In this case, the starting rotational phase can be the most retarded angle, the most advanced angle, or between the most retarded angle and the most advanced angle.

In the aforementioned embodiment, the stopper pin 32 can axially slide to be engaged with the engaging ring 36. The stopper pin 32 may radially slide to be engaged with the engaging ring. The stopper pin can be mounted in the driving rotation member and the engaging hole can be made in the driven rotation member.

The driving force from the crankshaft can be transferred to the camshaft through the chain sprocket. The chain sprocket can be replaced by a timing pulley or a timing gear. The vane rotor can receive a driving force from the crankshaft, and the camshaft and the shoe-housing can be rotated together.

What is claimed is:

1. A variable valve timing controller disposed in a torque transfer system from a driving shaft to a driven shaft of an internal combustion engine, the driven shaft opening and closing at least one of an intake valve and an exhaust valve, the variable valve timing controller adjusting opening and closing timing of at least one of the intake valve and the exhaust valve, comprising:

a housing rotating with one of the driving shaft and the driven shaft, and including a circumferential wall and side walls defining a chamber therein;

a vane rotor rotating with the other of driving shaft and the driven shaft, and having a vane accommodated in the chamber which is divided into a retard angle chamber and an advance angle chamber, the vane rotor rotating in a retard angle direction and advance angle direction relative to the housing while receiving a fluid pressure in the retard angle chamber and the advance angle chamber; and a bolt connecting the circumferential wall with one of side walls; wherein a projected portion is provided on one of an inner wall surface of the circumferential wall and an outer wall surface of the vane, the projected portion projecting toward the outer wall surface of the vane or the inner wall surface of the circumferential wall in a rotational direction;

when the inner wall surface and the outer wall surface are contact with each other at the projected portion, a center point of a force applied to the projected portion is located outside of an contacting area where the bolt is threaded into the circumferential wall in order that the circumferential wall is connected with the side wall by the bolt.

2. The variable valve timing controller according to claim 1, wherein an area in which the inner wall surface and the outer wall surface are contact with each other at the projected portion is located outside of the contacting area where the bolt is threaded into the connecting portion of the circumferential wall.

3. The variable valve timing controller according to claim 1, wherein the circumferential wall includes an annular portion having the inner wall surface and a connecting portion which extends radially outwardly from the annular portion, and the connecting portion is connected with the side wall by the bolt in the rotational direction.

4. The variable valve timing controller according to claim 3, wherein the annular portion includes a thin portion of which thickness is thinner than that of the connecting portion, and the thin portion is located between a contacting area of the projected portion and the connecting portion.

5. The variable valve timing controller according to claim 3, wherein the vane is provided with the projected portion on the outer wall surface thereof, and a thickness of the annular portion at which the inner wall surface is in contact with the projected portion is thinner than that of the connecting portion.

6. The variable valve timing controller according to claim 1, wherein the bolt is located radially outside of the center point.

7. The variable valve timing controller according to claim 1, wherein the circumferential wall and the other side wall are integrally formed.

8. The variable valve timing controller according to claim 1, wherein the circumferential wall is made of aluminum alloy.

* * * * *